US005700994A

United States Patent [19]

Gheer et al.

[11] Patent Number: 5,700,994

[45] Date of Patent: Dec. 23, 1997

[54] APPARATUS AND FUSER CONTROL METHOD FOR REDUCING POWER STAR FUSER RECOVERY TIME

[75] Inventors: Barry J. Gheer, Webster; Kenneth R. Rasch, Fairport; Tab A. Tress, Henrietta; Richard A. Geyer, Farmington, all of N.Y.

[73] Assignee: Xerox Corporation, Stamford, Conn.

[21] Appl. No.: 625,389

[22] Filed: Apr. 1, 1996

[51] Int. Cl.[6] ..... H05B 1/00

[52] U.S. Cl. ..... 219/497; 219/508; 219/216; 219/492; 399/94; 399/328

[58] Field of Search ..... 219/497, 499, 219/501, 505, 216, 492, 508, 509; 307/117; 399/94, 328, 330

[56] References Cited

U.S. PATENT DOCUMENTS

| | | | |
|---|---|---|---|
| 4,318,612 | 3/1982 | Brannan et al. . | |
| 4,355,225 | 10/1982 | Marsh | 219/216 |
| 4,377,739 | 3/1983 | Eckert, Jr. et al. | 219/497 |
| 4,551,007 | 11/1985 | Elter | 219/497 |
| 4,600,827 | 7/1986 | Linwood et al. | 219/492 |
| 4,710,676 | 12/1987 | Morris et al. | 313/579 |
| 4,920,250 | 4/1990 | Urban | 219/216 |
| 5,179,263 | 1/1993 | Koh et al. | 219/216 |
| 5,332,884 | 7/1994 | Barley | 219/494 |
| 5,350,896 | 9/1994 | Amico et al. | 219/216 |
| 5,481,089 | 1/1996 | Furuta | 219/497 |

*Primary Examiner*—Mark H. Paschall
*Attorney, Agent, or Firm*—Tallam I. Nguti

[57] ABSTRACT

A method and a fusing apparatus for producing a reduced recovery time period from a low energy-saver mode temperature back up to a high fusing temperature. The fusing apparatus includes a heating member for heating and fusing toner images onto a copy sheet; a temperature sensor mounted relative to the heating member for sensing temperature of the heating member; a source of primary power supply for supplying heating power to the heating member; a source of secondary power supply, that is less in level than the source of primary power supply, for supplying secondary heating power to the heated member; and a controller connected to the temperature sensor, and to the source of primary and the source of secondary power supplies for turning the source of primary and the source of secondary power supplies on and off responsively to the temperature sensor. The controller includes a program for, immediately and non-responsively to the temperature sensor, turning on the source of secondary power supply to immediately supply additional heat to the heating member when the fusing apparatus is switched to an energy-saver mode by turning off the primary power supply, thereby delaying a drop of a temperature of the heating member to the low, energy-saver mode temperature level.

7 Claims, 4 Drawing Sheets

APPARATUS AND FUSER CONTROL METHOD FOR REDUCING POWER STAR FUSER RECOVERY TIME

BACKGROUND OF THE INVENTION

This invention relates generally to electrostatographic reproduction machines, and particularly to apparatus and a fuser control method in such machine for reducing fusing temperature recovery time from a "power or energy star" low power or energy-saver mode requirements temperature.

In a typical electrostatographic reproduction process machine, a photoconductive member is charged to a substantially uniform potential so as to sensitize the surface thereof. The charged portion of the photoconductive member is imagewise exposed in order to selectively dissipate charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated at a thermal fusing apparatus at a desired operating temperature so as to fuse and permanently affix the powder image to the copy sheet.

In order to fuse and fix the powder toner particles onto a copy sheet or support member permanently as above, it is necessary for the thermal fusing apparatus to elevate the temperature of the toner images to a point at which constituents of the toner particles coalesce and become tacky. This action causes the toner to flow to some extent onto the fibers or pores of the copy sheet or support member or otherwise upon the surface thereof. Thereafter, as the toner cools, solidification occurs causing the toner to be bonded firmly to the copy sheet or support member.

One approach to thermal fusing of toner images onto the supporting substrate is illustrated for example in U.S. Pat. No. 5,350,896, and U.S. Pat. No. 4,920,250. This approach involves passing the substrate with the unfused toner images thereon into nip contact between a pair of opposed roller members at least one of which is heated, and its temperature controlled at a desired high operating or fusing temperature level of about 350 degrees Fahrenheit. Another approach as disclosed for example in U.S. Pat. No. 4,355,225 involves radiant fusing in which the substrate with the unfused toner image thereon is passed without contact, through a radiantly heated channel formed in part by a radiant heat member. The radiant heat member maintains the channel temperature during run or operating periods at the desired high operating or fusing temperature of about 350 degrees Fahrenheit.

As is well known, when started up, each reproduction machine typically goes through a warm up phase during which the heated member of the fusing apparatus gradually warms up to where the fusing channel or fusing nip reaches and can be maintained at the high fusing temperature. After that, the machine can be activated to run a job reproducing images through a run or operating cycle. After one of such jobs, the machine may be idle (or even go into an idle or a "standby" mode), while waiting for the next reproduction job. Conventionally, an efficiency practice as disclosed for example in U.S. Pat. No. 4,920,250 has been to turn off the power supply upon entering a idle or standby mode, and to allow the temperature of the fusing nip or channel to drop to, and to then be controlled by restarting and shutting off the power supply, at a lower temperature level.

Consistent with such a conventional practice, environmentally sensitive and market place regulations, now call for office equipment, particularly electrostatographic reproduction machines, to be more energy efficient. Such environmental regulations or requirements for office products are covered in the US under what is currently called the "Energy Star Program", and under various other similar programs in Europe and elsewhere. Such similar programs include "New Blue Angel" (Germany), "Energy Conservation Law" (Japan), "Nordic Swan" (North Europe), and "Swiss Energy Efficiency Label" (Switzerland).

Under the "Energy or Power Star Program" in the United States, several modes are defined for copiers or electrostatographic reproduction machines. These modes for example include the operating or copying mode, the standby mode, and the low-power or energy-saver mode. The low-power or energy-saver mode is the lowest power state a copier can automatically enter within some period of copier inactivity, without actually turning off. The copier enters this mode within a specified period of time after the last copy was made. When the copier is in this mode, there may be some delay before the copier will be capable of making the next copy. For purposes of determining the power consumption in this low-power mode, a company may choose to measure the lowest of either the energy-saver mode or the standby mode.

The copier or machine enters the standby mode when it is not in the operating or copying mode making copies, but had just previously been in the operating mode. In the standby mode, the copier or machine is consuming less power than when the machine is in the operating mode but is ready to make a copy, and has not yet entered into the energy-saver mode. When the copier is in the standby mode, there will be virtually no delay before the copier is back in the operating mode and capable of making the next copy.

When the machine is in the low-power or energy-saver mode, these regulations call for the total power being consumed by the machine to be limited to no more than 125 watts, of which no more than 50 watts can be to the fusing apparatus. When the copier or machine experiences prolonged low-power or energy-saver mode periods, this level of limited power (50 watts) to the fusing apparatus usually is only sufficient to maintain the temperature of the fusing apparatus at a temperature that is significantly below the desired high and ready-to-run fusing temperature of about 350 degrees Fahrenheit.

Timely and satisfactory recovery from such a significantly low low-power or energy-saver mode temperature back to the desired high fusing temperature is ordinarily difficult. This is because once the temperature of a fusing apparatus starts to drop or fall, it acquires a thermal inertia which then makes reversal or recovery difficult. Unfortunately, the "power or energy star" regulations, have made such a concern a problem for conventionally designed and controlled fusing apparatus, by calling for the reproduction machine to fully recover from such a low-power or energy-saver mode temperature back up to the desired, high fusing temperature in 30 seconds or less.

Under conventional practice, recovery times have been found to be unacceptably long and beyond the 30 seconds called for by the regulations. There is therefore a need for apparatus and a fuser control method for controlling fusing apparatus power consumption so as to satisfy "Power or Energy Star" requirements, and so as to significantly reduce the recovery time from low-power or energy-saver mode conditions of the machine.

SUMMARY OF THE INVENTION

In accordance with one aspect of the present invention, there is provided a method of reducing a fusing apparatus recovery time from a low energy-saver mode temperature back up to a high fusing temperature. The method includes supplying full power to a heated member of the fusing apparatus to warm the fusing apparatus from a start up temperature to the high fusing temperature; ending full power supply and then turning a source of primary power supply on and off, for supplying power to the heated member, to control the fusing apparatus temperature at the high fusing temperature; identifying and timing an idle period that lasts a predetermined length of time during which the fusing apparatus is being controlled at the high fusing temperature; turning the source of primary power supply off at the end of the idle period lasting the predetermined length of time, and immediately turning on a source of secondary power supply, that is less in level than the source of primary power supply, for immediately supplying power at an energy-saver mode level to the heated member when the fusing apparatus temperature is still substantially at the high fusing temperature, thereby delaying a drop of the fusing apparatus temperature towards the low energy-saver mode temperature; and resupplying full power to the heated member of the fusing apparatus, at some time as desired, to reheat the heated member from a relatively higher temperature owing to the delayed drop, back up to the high fusing temperature, thereby resulting in a desirably reduced recovery time from such relatively higher temperature.

In accordance with another aspect of the present invention, there is provided a fusing apparatus for producing a reduced recovery time period from a low energy-saver mode temperature back up to a high fusing temperature. The fusing apparatus includes a heating member for heating and fusing toner images onto a copy sheet; a temperature sensor mounted relative to the heating member for sensing temperature of the heating member; a source of primary power supply for supplying heating power to the heating member; a source of secondary power supply, that is less in level than the source of primary power supply, for supplying secondary heating power to the heated member; and a programmable controller connected to the temperature sensor, and to the source of primary and the source of secondary power supplies for turning the source of primary and the source of secondary power supplies on and off responsively to the temperature sensor. The controller includes a program for, immediately and non-responsively to the temperature sensor, turning on the source of secondary power supply to immediately supply additional heat to the heating member when the fusing apparatus is switched to an energy-saver mode by turning off the primary power supply, thereby delaying a drop of a temperature of the heating member to the low, energy-saver mode temperature level.

BRIEF DESCRIPTION OF THE DRAWINGS

In the detailed description of the present invention presented below, reference is made to the drawings, in which.

DETAILED DESCRIPTION OF THE PREFERRED EMBODIMENT OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 5:
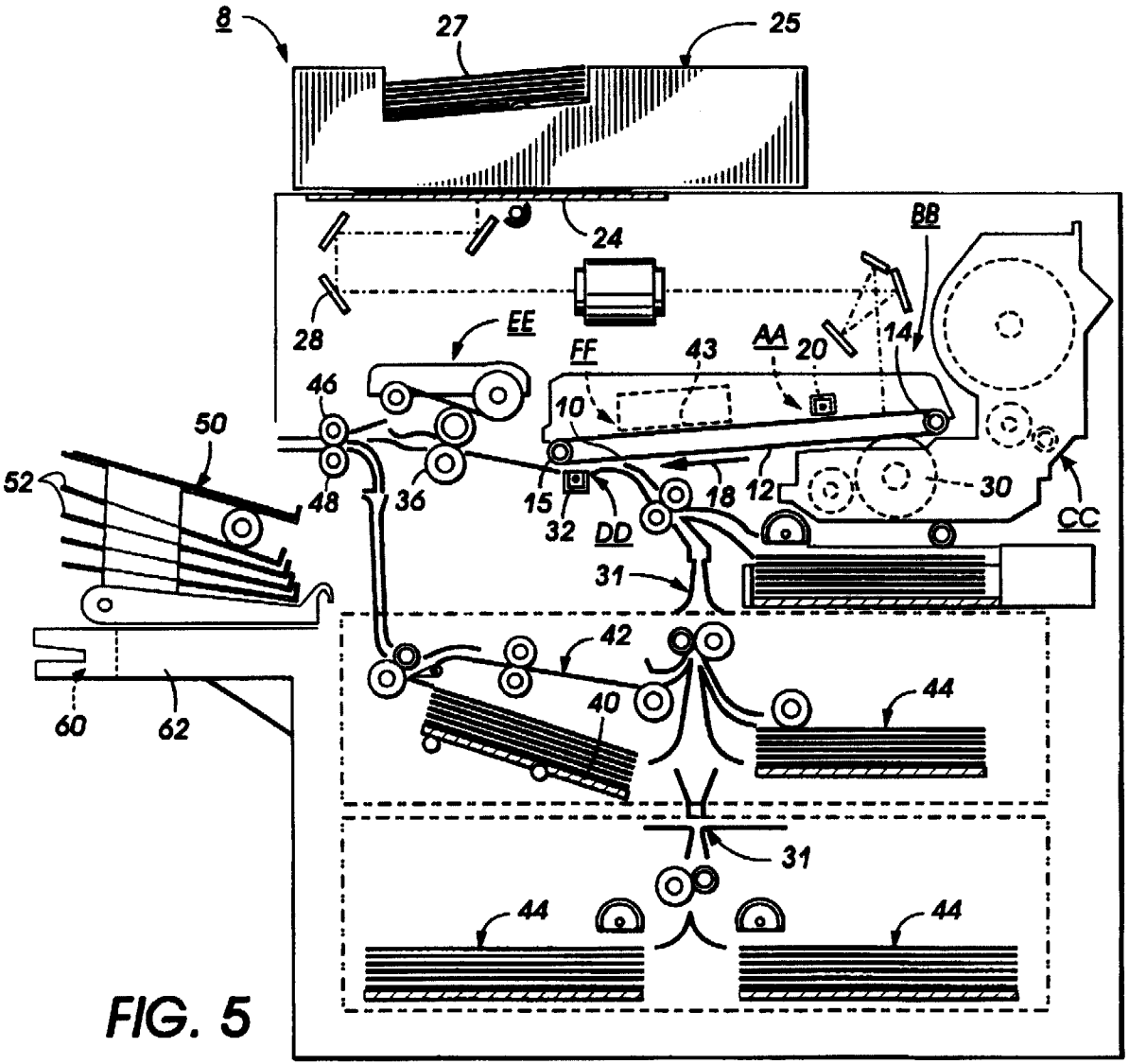
FIG. 5 is a vertical schematic of an exemplary electrostatographic reproduction machine including the fusing apparatus of FIG. in accordance with the present invention.

Referring first to FIG. 5, an exemplary electrostatographic reproduction machine 8 according to the present invention is illustrated. As shown, the machine 8 has conventional imaging processing stations associated therewith, including a charging station AA, an imaging/exposing station BB, a development station CC, a transfer station DD, fusing station EE including an exemplary fusing apparatus in accordance with the present invention (to be described in detail below), a cleaning station FF, and a finishing station shown generally as GG.

As shown, the machine 8 has a photoconductive belt 10 with a photoconductive layer 12 which is supported by a drive roller 14 and a tension roller 15. The drive roller 14 functions to drive the belt in the direction indicated by arrow 18. The drive roller 14 is itself driven by a motor (not shown) by suitable means, such as a belt drive.

The operation of the machine 8 can be briefly described as follows. Initially, the photoconductive belt 10 is charged at the charging station AA by a corona generating device 20. The charged portion of the belt is then transported by action of the drive roller 14 to the imaging/exposing station BB where a latent image is formed on the belt 10 corresponding to the image on a document positioned on a platen 24 via the light lens imaging system 28 of the imaging/exposing station BB. It will also be understood that the light lens imaging system can easily be changed to an input/output scanning terminal or an output scanning terminal driven by a data input signal to likewise image the belt 10. As is also well known, the document on the platen 24 can be placed there manually, or it can be fed there automatically by an automatic document handler device 25 that includes a multiple document sheet holding tray 27.

The portion of the belt 10 bearing the latent image is then transported to the development station CC where the latent image is developed by electrically charged toner material from a magnetic developer roller 30 of the developer station CC. The developed image on the belt is then transported to the transfer station DD where the toner image is transferred to a copy sheet fed by a copy sheet handling system 31. In this case, a corona generating device 32 is provided for charging the copy sheet so as to attract the charged toner image from the photoconductive belt 10 to the copy sheet. The copy sheet 44 with the transferred image thereon is then directed to the fuser station shown generally as EE.

Fuser station EE includes a fuser or fusing apparatus, shown for example as a roller type fusing apparatus 122 in accordance with the present invention. Although a roller type fusing apparatus (FIG. 1) is illustrated, it is understood that the method of the present invention can be equally practiced using a radiant type fusing apparatus (FIG. 2). In any case, the fusing apparatus operates to heat, fuse and fix the toner image onto the copy sheet 44. The copy sheet then, as is well known, then may be selectively transported to the finishing area GG, or along a selectable duplex path 42, to a duplex tray 40.

Meanwhile, the portion of the belt 10 from which the developed image was transferred is then advanced to the cleaning station FF where residual toner and charge on the belt are removed by a cleaning device such as a blade 43, and a discharge lamp (not shown) in order to prepare the portion for a subsequent imaging cycle.

When not doing duplex imaging, or at the end of such duplex imaging, copy sheets upon finally leaving the fusing rolls 34, 36, are passed to finishing area input rolls 46 and 48. From the input rolls 46, 48, the copy sheets are fed, for example, individually to an output tray (not shown) or to a bin sorter apparatus 50 where the sheets can be arranged in a collated unstapled set within the tray or within each bin 52 of a bin sorter apparatus. The bin sorter apparatus 50 can comprise any number of bins 52, which as are well known, can be designed to nest, as well as to indexably cycle past a fixed loading point for sheets. A machine user making such set of copy sheets on the reproduction machine 8 can thus manually remove each such set at a time, and insert a corner or edge of the set into a convenience stapler assembly 60 for convenient stapling. As shown, the convenient stapler assembly 60 is built into a portion 62 of the frame of the machine 8, and at a location conveniently close to the bin sorter apparatus or output tray.

Figure 1:
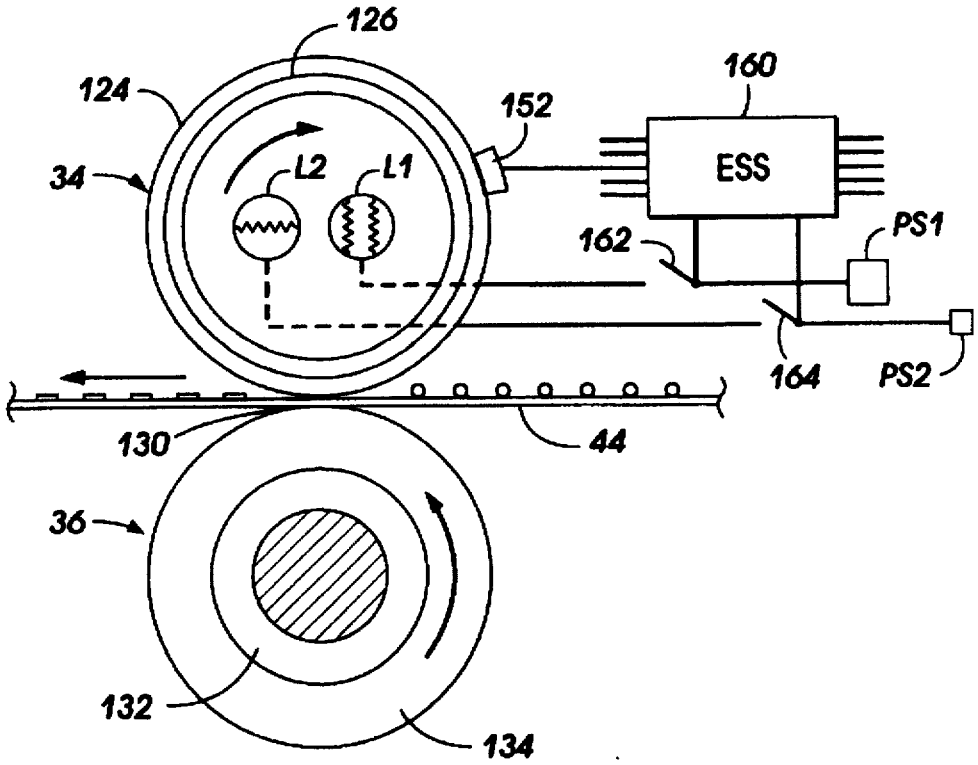
FIG. 1 is a schematic illustration of a roller type fusing apparatus in accordance with the present invention.
Figure 2:
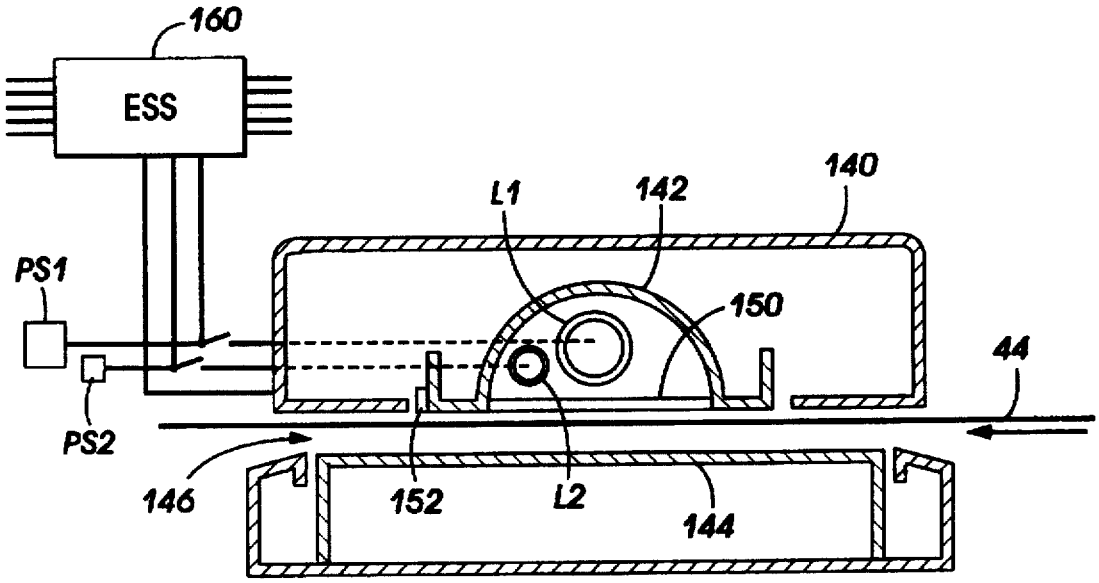
FIG. 2 is a schematic illustration of a radiant type fusing apparatus in accordance with the present invention.

Referring now to FIGS. 1, 2 and 5, the fusing apparatus of the present invention may comprise a roller type fusing apparatus 122 (FIGS. 1 and 5) that includes a heating member in the form of a heated fuser roller or roll 34. The roller 34 as shown has a deformable elastomeric surface 124 that is formed over a suitable base member 126. Base 126 is preferably a hollow cylinder or core that is fabricated from any suitable metal such as aluminum, anodized aluminum, steel, nickel, copper, or the like. Fuser roll 34 also includes at least a first and primary heated member or element L1, and a second and secondary heated member or element L2. Both heated elements L1, L2 are disposed within the hollow portion of the cylindrical core or base 126, and are coextensive with a length of the hollow cylinder or base 126.

The roller type fusing apparatus 122 also includes a backup or pressure roller or roll 36 which cooperates with the fuser roll 34 to form a nip or contact arc 130 through which the copy sheet or substrate 44 is passed such that toner images thereon contact the elastomeric surface 124 of fuser roll 34. As shown in FIG. 1, the backup or pressure roll 36 preferably has a rigid hollow core 132 and an outer surface layer 134 consisting, for example, of a copolymer perfluoroalkyl perfluorovinyl ether with tetrafluroethylene (PFA).

The fusing apparatus of the present invention may also comprise a radiant fusing apparatus 136 (FIG. 2), (although a radiant type fusing apparatus is not shown as the option in FIG. 5). As shown, the radiant fusing apparatus 136 includes a housing 140, a reflector means 142, a platen 144 defining a fusing channel 146 with the housing 140, and at least a primary heated member in the form of a source L1 of radiant heat, and a secondary source L2 of radiant heat for heating the channel 146 through a quartz shield 150. The copy sheet or substrate 44 is advanced into the heated channel 146 by an upstream conveyor device (not shown) and is taken away from the channel by a pair of downstream rollers(also not shown).

Referring still to FIGS. 1 and 2, the fusing apparatus 122, 136 of the present invention includes at least a source of main or primary power supply PS1 connected to the primary heated member L1. PS1 is designed to output a sufficient level of power for maintaining the temperature of the fusing nip 130 or fusing channel 146 at the desired high fusing temperature of about 350 degrees Fahrenheit. The fusing apparatus 122, 136 also each includes a source of secondary power supply PS2 designed to provide a level of power that is less than that of the primary source PS1, and is equal, for example, to the "power or energy star" power level of 50 watts maximum during low-power or energy-saver mode periods. Although PS1, and PS2 are shown as two separate power supply sources, they may in fact be merely two levels of power supply from a single source that is controllable by software.

A temperature sensor shown as 152 is provided for sensing the temperature of the fuser roller 34 or of the fusing channel 146. Importantly as illustrated, the fusing apparatus 122, 136 of the present invention includes a controller 160 that is connected to the temperature sensor 152, and to the sources of power PS1, PS2 via switches 162, 164 respectively.

Figure 3:
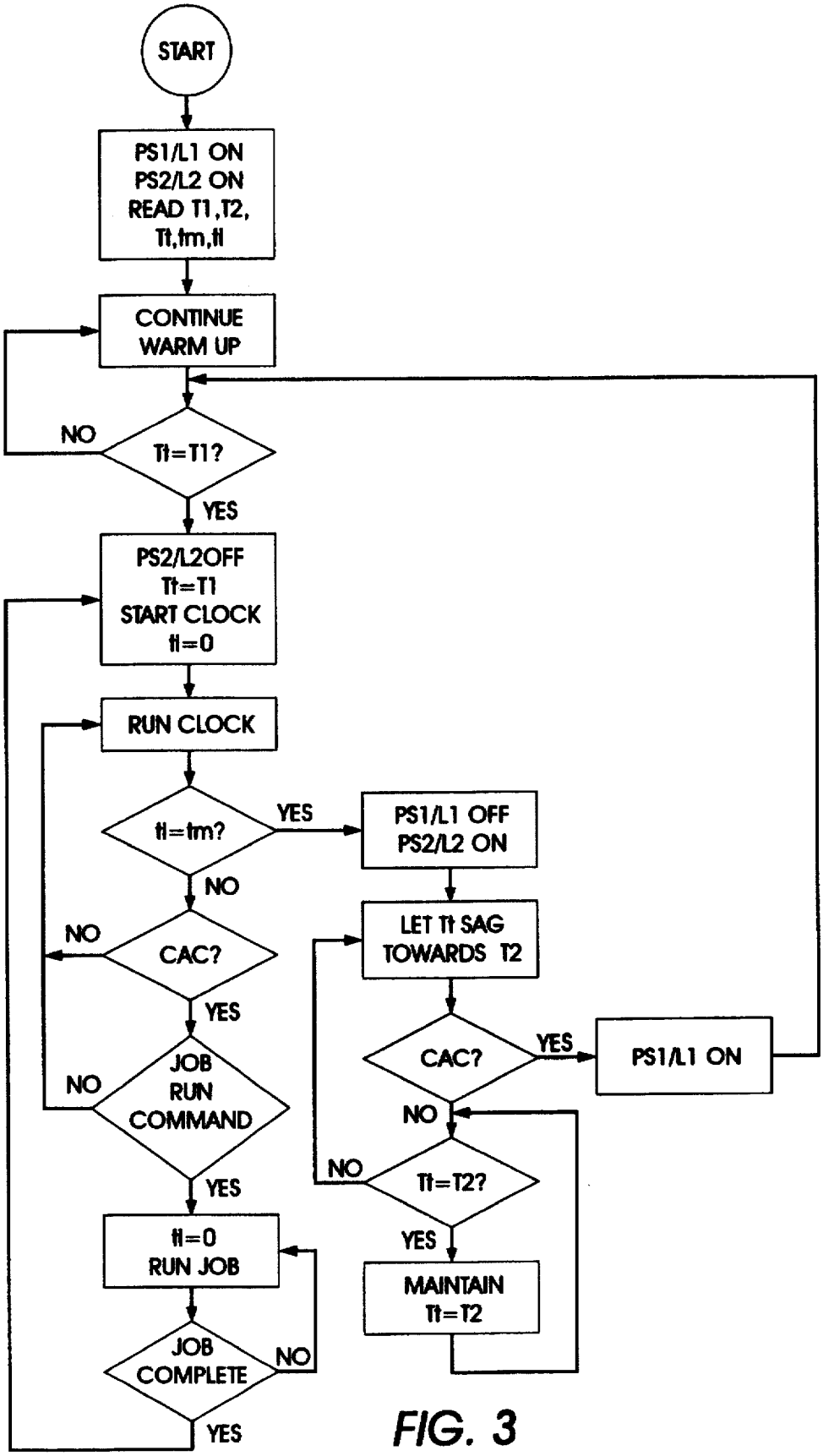
FIG. 3 is a flow chart for the method of controlling the fusing apparatus of FIG. 1 or 2 in accordance with the present invention.
Figure 4:
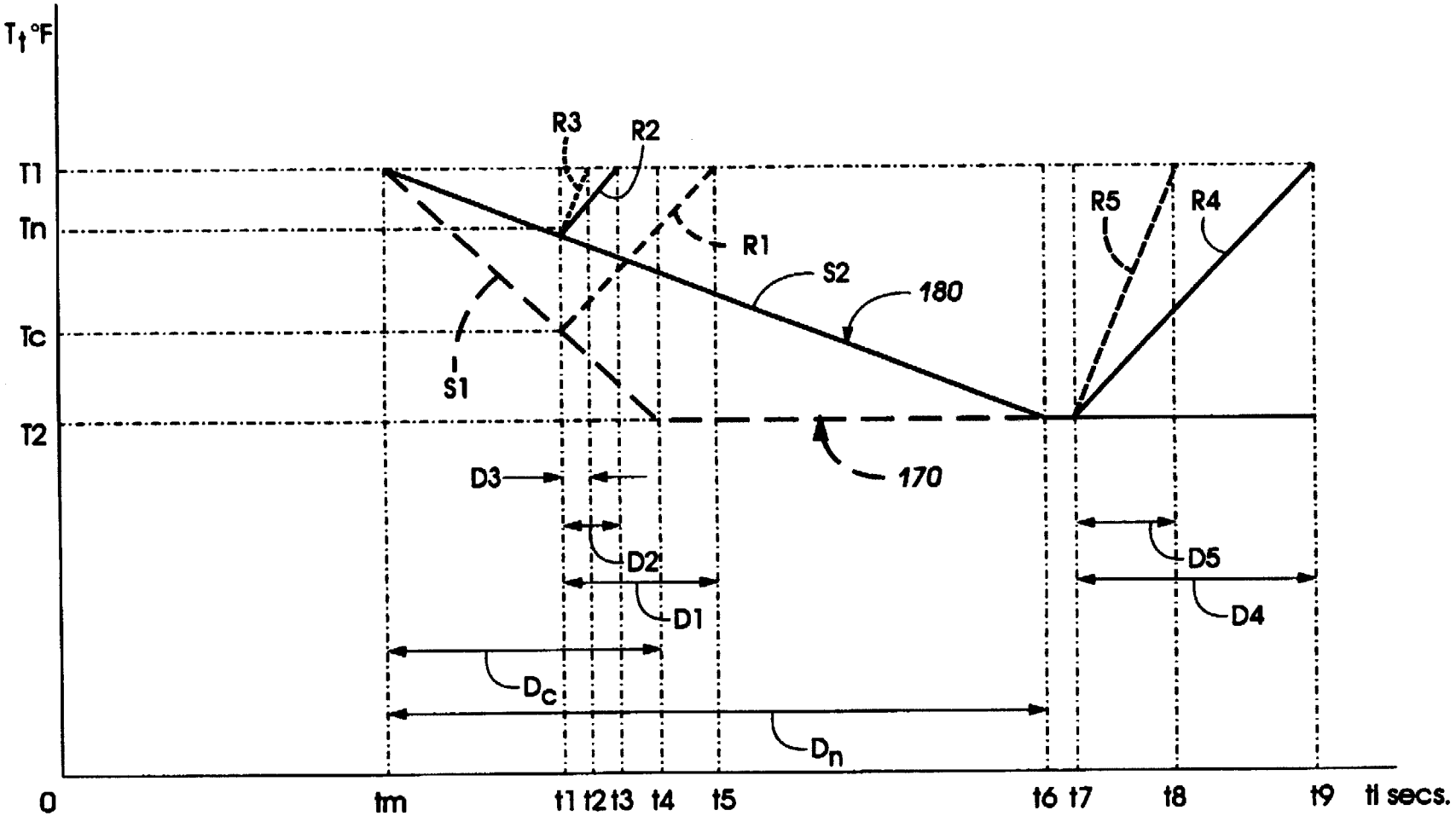
FIG. 4 is a plot of fusing nip or channel temperature versus time, for the method of FIG. 3.

Referring now to FIGS. 3 and 4, the operation and reduced recovery time results of the fusing apparatus 122, 136 of the present invention, are illustrated. At start up, PS1, L1 are turned on so as to warm up the fuser roll 34, or channel 146 until the desired high fusing temperature T1 is reached. In accordance with one aspect of the present invention, the actual time taken to reach temperature T1 can be reduced by also turning on the source of secondary power supply and heated member PS2, L2 respectively. For controlling the operation of the fusing apparatus 122, 136, the controller 160 reads control values that include T1 (fusing temperature of fuser roller 34 or channel 146); T2 (low-power or energy-saver mode temperature of fuser roller 34, or channel 146); Tt (sensor temperature reading; "ti" (mode clock passing time); and "tm" (the programmed time lapse for machine to switch to low-power or energy-saver mode after reaching temperature T1).

Several temperature checks may be made during the warmup phase until Tt reaches T1. If initially turned on, the source of secondary power supply PS2 and heated member L2 respectively are then turned off when Tt reaches T1. In addition, the mode clock is started, "ti" is set to zero, and Tt is then maintained by the power source PS1 and heated member L1 at T1. After the warm up is completed, as such, the mode clock will continue to run with "ti' adding up until a "copying activity command" (CAC) such as entry of a number of copies to be made, or selection of a reduction/enlargement value, as well as a "job run command" are received. At that point, the mode clock time "ti" is reset to zero, and the job is run and completed. During the running of the job, Tt is controlled at T1. The mode clock is then restarted at the completion of each such job.

After warmup or after a job is completed, if no "job run command" is received by the time the started mode clock time "ti" equals "tm", the machine then automatically switches to the low-power or energy-saver mode. At the moment of such switch, with Tt still at substantially T1, the power source PS1 and heated member L1 are turned off.

Conventionally, the temperature Tt will ordinarily then be allowed to freely drop towards the low-power or energy-saver mode temperature T2 where it is then controlled conventionally at T2, for example, by PS1 controllably supplying heating power to the heated member L1. Such a conventional free temperature drop of Tt towards T2 is illustrated in FIG. 4 by the slope portion S1 of the temperature versus time plot 170. The drop from T1 to T2 along slope S1 as shown, ordinarily should take, for example, a time period shown as Dc starting from "tm". As noted above, a delay is usually expected for the machine to recover from any point along the temperature conventional drop slope S1 of the curve 170, back to the fusing temperature T1.

For example, if a "copying activity command" including a "job run command" are received at time "t1" during the temperature Tt conventional drop towards T2, the actual temperature Tt will be at Tc which is below T1. The power supply PS1 will therefore be immediately turned back on in order to start reheating the heat member L1. A conventional delay shown as D1 can be expected while the temperature Tt recovers to T1 along a conventional recovery slope shown as R1.

On the other hand, in accordance with the apparatus and fuser control method of the present invention, at the moment when "ti" equals "tm" thus initiating an automatic mode switch to the low-power or energy-saver mode, and with Tt still substantially at T1, the power supply PS1 and heated member L1 will be turned off as is the case conventionally. Importantly, however, the secondary or lower power supply PS2 is immediately turned on, non-responsively to the temperature sensor 152 in accordance with the present invention, so as to immediately start supplying additional heat to the fuser roller 34 or fusing channel 146, even when the temperature Tt is still at substantially T1. As an immediate effect, the temperature Tt will stay substantially at T1 a lot longer, and may actually rise slightly and temporarily above T1 before starting to drop. In other words, the temperature Tt will not be allowed, as is done conventionally, to immediately start freely dropping towards the low-power or energy-saver mode temperature T2. The effect of immediately intervening such a conventional drop with the lower power supply PS2 is to immediately start delaying the actual drop. The delayed drop is illustrated in FIG. 4, for example, by the slope S2 of the curve 180. As can be seen, the drop from T1 to T2 according to the present invention relatively takes a period of time shown as Dn which is far longer than Dc.

One great advantage of the delayed temperature drop strategy of the present invention, is a significantly reduced or shorten recovery time back to T1, particularly during the time period Dn. For example as shown, if a "copying activity command" including a "job run command" are received at time "t1" during the delayed temperature drop to T2 in accordance with the present invention, the power supply PS1 will immediately be turned back on to start reheating the heat member L1.

It should be noted that at the time "t1" the actual temperature of the fuser roller 34 or channel 146, according to the present invention, is at Tn which is below T1 but higher than Tc. A significantly shorter delay D2 (as compared to D1) would therefore be experienced before the temperature Tt is back up from Tn to T1. If the same level of power, e.g. PS1, is used, then the recovery slope R2 even for the shorter delay D2, will be parallel to that R1 under conventional circumstances.

Furthermore, in accordance with the present invention, however, the actual recovery time can be reduced further from D2 to D3 as shown. To do so, instead of just PS1 being turned on, both power supplies PS1 and PS2 are immediately turned on so as to supply heat to both L1 and L2 which would bring the temperature Tt even much faster along a steeper slope R3 from Tn back to T1.

Such advantages of the present invention are achievable even after the temperature Tt, although delayed, eventually drops to T2, where it is then controlled at T2 in accordance to the present invention by PS2 controllably supplying heating power to the heated member L2. For example, at time "t7" when the temperature Tt is already at T2, recovery time conventionally or in accordance with the present invention, would be the same D4, which is equal to 30 seconds under "power or energy star" requirements. Recovery for example will be along a slope R4 if the same level of power, e.g. PS1, is used in either case. It should be noted that the slope R4 is parallel to the slopes R1 and R2 which rely on this same level of power. Further, it should also be noted that in accordance with the present invention, this delay of D4 does not come into effect until after the time period Dn at t6, which has been found to be approximately 60 minutes. For the conventional situation represented by the temperature drop curve 170, this delay time of D4, and recovery slope R4 instead come into effect as soon as Tt reaches T2 at time t4, which was only after the time period of Dc (which has been found to be approximately 20 minutes).

Further however, in accordance with the present invention, a shorter recovery time D5 is also possible after time t6 when both PS1 and PS2 are relied on to bring the temperature from T2 back up to T1 along a steeper recovery slope R5. Again, it should be noted that R5 is parallel to R3 (which also relied on both PS1 and PS2). Accordingly, it is clear that a significantly reduced delay D2, D3 and D5 will be experienced for the machine to recover from any point along the delayed temperature drop curve 180 of the present invention back up to the fusing temperature T1, along recovery slopes R2, R3 and R5.

As can be seen, there has been provided in accordance with present invention, apparatus and a fuser control method that effectively meets the power or energy star program requirements. The apparatus and method of the present invention effectively allow the fusing apparatus 122, 136 in an electrostatographic reproduction machine to consume no more than 50 watts of power in a low-power or energy saver mode, and to be able to recover in a significantly reduced period of time of 30 seconds or less, back to a ready condition. Accordingly, operators no longer need to spend undesirably long periods of time waiting for the copier to recover and become ready.

While the invention has been described with reference to particular preferred embodiments, the invention is not limited to the specific examples shown, and other embodiments and modifications can be made by those skilled in the art without departing from the spirit and scope of the invention and claims.

What is claimed is:

1. A method of reducing a fusing apparatus recovery time from a low energy-saver mode temperature back up to a high fusing temperature, the method comprising:

(a) supplying full power to a heated member of the fusing apparatus to warm the fusing apparatus from a start up temperature to the high fusing temperature;

(b) ending full power supply and then turning a primary power supply on and off so as to control the fusing apparatus temperature at the high fusing temperature;

(c) identifying and timing an idle period that lasts a predetermined length of time during which the fusing apparatus temperature is being controlled at the high fusing temperature;

(d) turning the primary power supply off at the end of the idle period lasting the predetermined length of time, and immediately turning on a secondary power supply for immediately supplying power at an energy-saver mode level to the heated member when the fusing apparatus temperature is still substantially at the high fusing temperature, thereby delaying a drop of the fusing apparatus temperature towards the low energy-saver mode temperature; and (e) resupplying, as desired at some time, full power to the heated member of the fusing apparatus to reheat the heated member from a relatively higher temperature at such time owing to the delayed drop, back up to the high fusing temperature, thereby resulting in a desirably reduced recovery time from such relatively higher temperature back up to the high fusing temperature.

2. The method of claim 1, wherein said step of supplying full power comprises turning on the primary power supply to supply heat to a primary heated member, and turning on a secondary power supply to supply additional heat to a secondary heated member.

3. The method of claim 1, wherein said step of resupplying full power comprises turning on both the primary power supply and the secondary power supply to both supply heat to the heated member during the reduced recovery time period.

4. The method of claim 2, wherein said step of ending full power supply includes turning off the secondary power supply.

5. A fusing apparatus for producing a reduced recovery time period from a low energy-saver mode temperature back up to a high fusing temperature, the fusing apparatus comprising:

(a) a heating member for heating and fusing toner images onto a copy sheet;

(b) a temperature sensor mounted relative to said heating member for sensing a temperature of said heating member;

(c) a source of primary power supply for supplying heating power to said heating member;

(d) a source of secondary power supply for supplying secondary heating power to said heating member, said source of secondary power supply supplying a lower level of power than said source of primary power supply; and (e) a programmable controller connected to said temperature sensor, and to said source of primary and said source of secondary power supplies for turning said source of primary and said source of secondary power supplies on and off responsively to said temperature sensor, said controller including program means for, immediately and non-responsively to said temperature sensor, turning on said source of secondary power supply to immediately supply additional heat to said heating member when the fusing apparatus is switched to an energy-saver mode by turning off said source of primary power supply, thereby delaying a drop of the temperature of said heating member to the low, energy-saver mode temperature.

6. The fusing apparatus of claim 5, wherein said heating member comprises a fuser roller forming a fusing nip with a backup pressure roller, and including a primary heated member connected to said source of primary power supply, and a secondary heated member connected to said source of secondary power supply.

7. The fusing apparatus of claim 5, wherein said heating member comprises a radiant heat assembly having a fusing channel and including a primary radiant heat source connected to said source of primary power supply, and a secondary radiant heat source connected to said source of secondary power supply.

* * * * *